United States Patent [19]

Fillmore

[11] Patent Number: 4,573,599

[45] Date of Patent: Mar. 4, 1986

[54] CHILD RESISTANT PACKAGE WITH TAMPER INDICATING BAND

[75] Inventor: William E. Fillmore, Toledo, Ohio

[73] Assignee: Owens-Illinois, Inc., Toledo, Ohio

[21] Appl. No.: 704,844

[22] Filed: Feb. 25, 1985

[51] Int. Cl.[4] ..... B65D 55/02

[52] U.S. Cl. ..... 215/225; 215/256

[58] Field of Search ..... 215/224, 225, 253, 254, 215/256

[56] References Cited

U.S. PATENT DOCUMENTS

| | | | |
|---|---|---|---|
| 4,341,318 | 7/1982 | Smalhey | 215/225 |
| 4,511,051 | 4/1985 | Desai | 215/225 |
| 4,527,702 | 7/1985 | Heath, Jr. | 215/225 |

*Primary Examiner*—George T. Hall

*Attorney, Agent, or Firm*—John R. Nelson

[57] ABSTRACT

A child-resistant package with a snap-on closure comprising a container having a neck finish including an annular retaining bead having at least one notch therein and a closure having a top wall and peripheral skirt, the skirt having a lifting tab on the outer surface thereof and a radially inwardly extending locking lug on the inner surface thereof adjacent the external lifting tab. The closure includes a tamper indicating band attached to the skirt by a plurality of circumferentially attached bridge portions. The band is formed with a plurality of circumferentially spaced vertical ribs. The finish of the container includes a plurality of circumferentially spaced vertical ribs such that when the closure is applied to the container, the ribs on the closure and the ribs on the container interengage in such a manner that the locking lug on the container can not be aligned with the notch on the container and prevents the closure from being rotated to align the locking lug from being aligned with the notch on the container until the band is partially severed from the closure.

15 Claims, 10 Drawing Figures

CHILD RESISTANT PACKAGE WITH TAMPER INDICATING BAND

This invention relates to child-resistant packages and particularly child-resistant packages of the snap-on closure type.

BACKGROUND AND SUMMARY OF THE INVENTION

One common type of child-resistant closure that has been utilized is the arrangement as shown in U.S. Pat. Nos. 3,871,662 and 4,375,859 wherein the container has an annular bead thereon with at least one notch therein and the closure has a locking lug on the skirt thereof which must be brought into alignment with a notch to remove the closure by an upward force.

It has heretofore been suggested that a tamper indicating band can be provided in such a package by having a tamper indicating tab formed on the closure with a radially inwardly extending lug such that when the locking lug is aligned with a notch in the bead the closure cannot be removed until the tab portion of the band is severed from the skirt of the closure. Such an arrangement is disclosed and claimed in the copending application Kirit C. Desai, Ser. No. 612,498, filed May 21, 1984, having a common assignee with the present application.

Among the objectives of the present invention are to provide a tamper indicating device for such child-resistant packages which is of a different type and which is low in cost and can be readily adapted to child-resistant packages of the aforementioned type.

In accordance with the invention, a child-resistant package with a snap-on closure comprises a container having a neck finish including an annular retaining bead having at least one notch therein and a closure having a top wall and peripheral skirt, the skirt having a lifting tab on the outer surface thereof and a radially inwardly extending locking lug on the inner surface thereof adjacent the external lifting tab. The closure includes a tamper indicating band attached to the skirt by a plurality of circumferentially attached bridge portions. The band is formed with a plurality of circumferentially spaced vertical ribs. The finish of the container includes a plurality of circumferentially spaced vertical ribs such that when the closure is applied to the container, the ribs on the closure and the ribs on the container interengage in such a manner that the locking lug on the container can not be aligned with the notch on the container and prevents the closure from being rotated to align the locking lug from being aligned with the notch on the container until the band is partially severed from the closure.

DESCRIPTION

Figure 2:
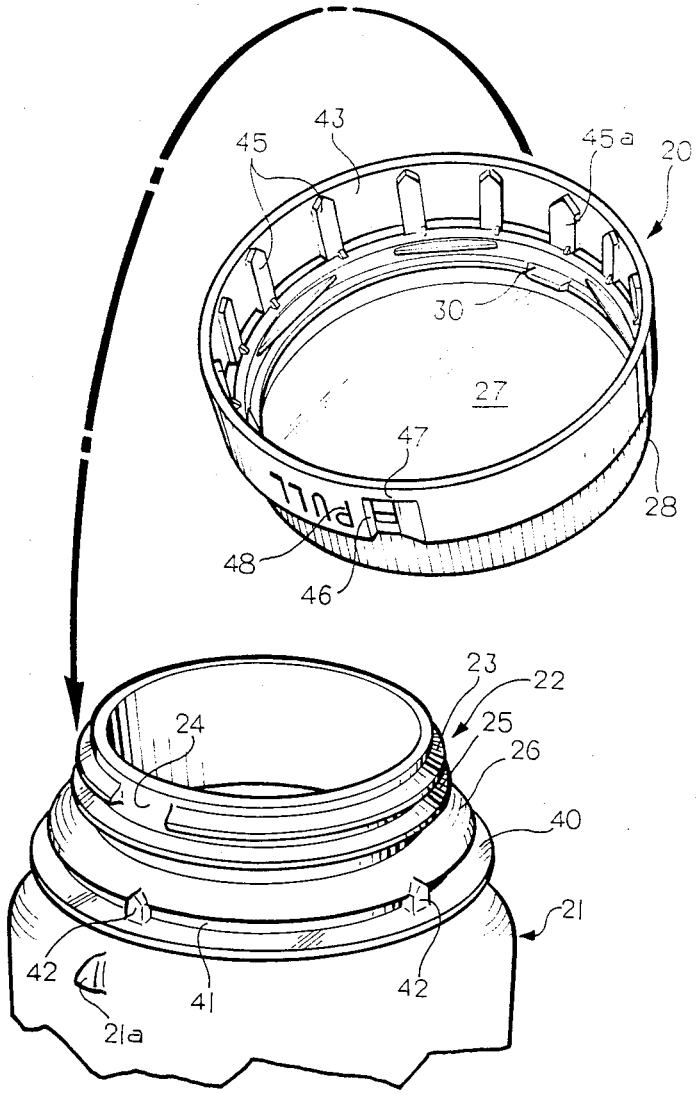
FIG. 2 is a fragmentary exploded perspective view of the child resistant package.
Figure 1:
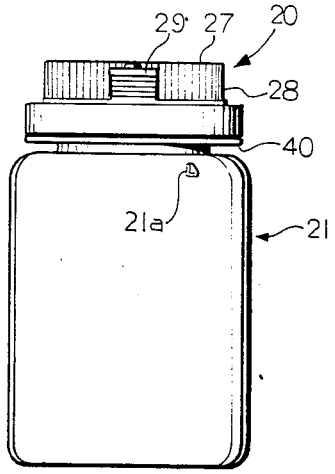
FIG. 1 is an elevational view of a child resistant package embodying the invention.
Figure 4:
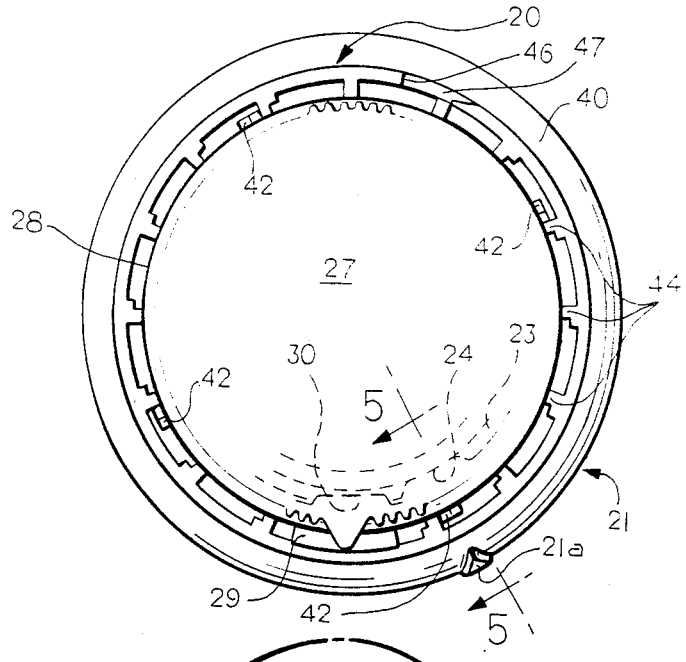
FIG. 4 is a plan view of the child resistant package.
Figure 3:
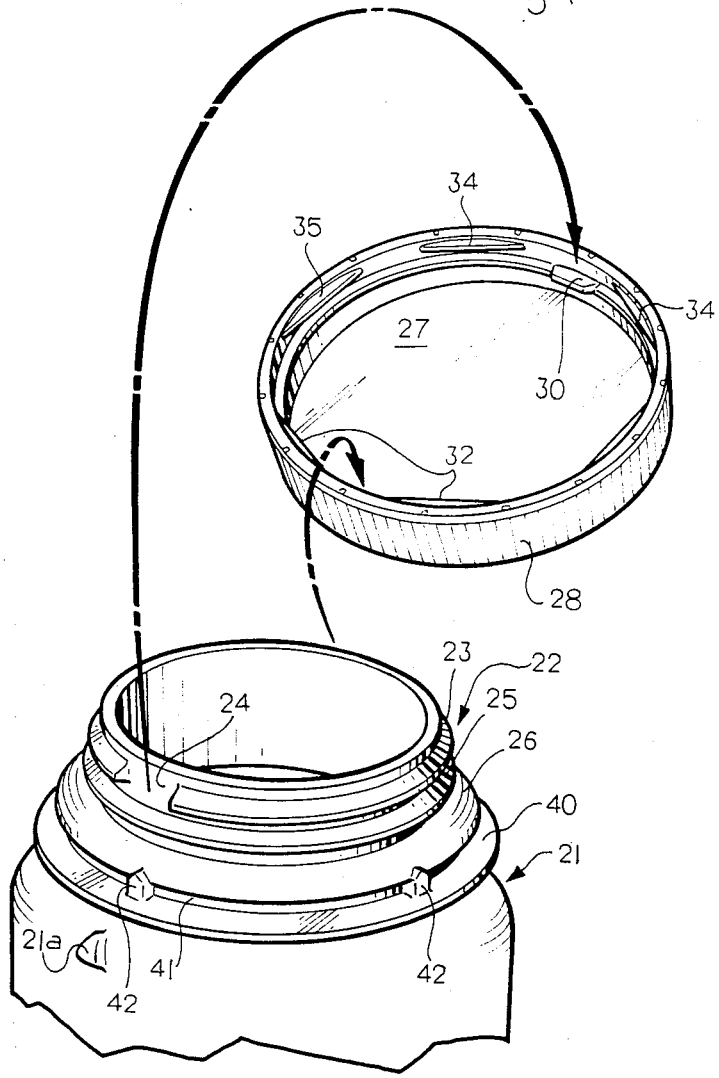
FIG. 3 is a view similar to FIG. 2 showing the package after the tamper indicating band has been removed.
Figure 5:
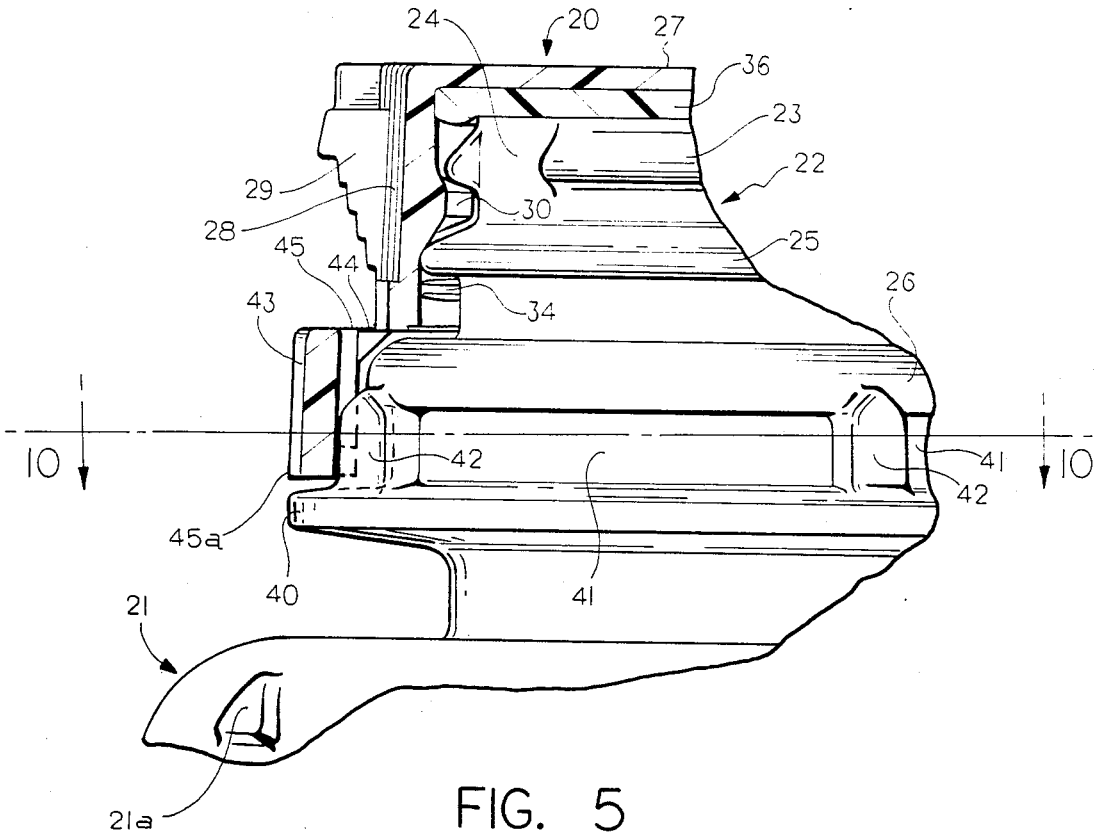
FIG. 5 is a fragmentary sectional view on an enlarged scale taken along the line 5—5 in FIG. 4.
Figure 6:
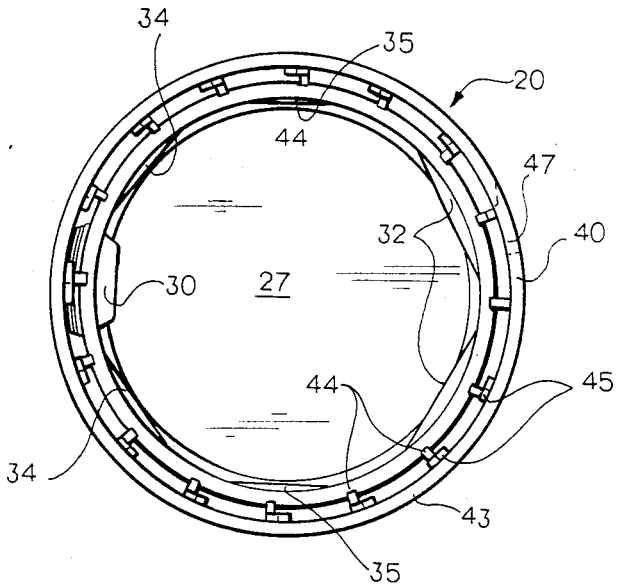
FIG. 6 is a bottom plan view of the closure.
Figure 7:
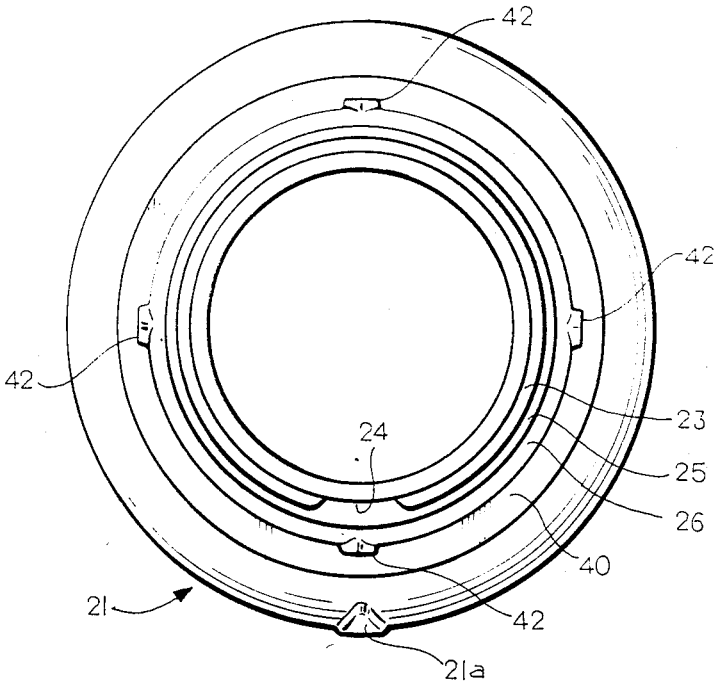
FIG. 7 is a top plan view of the container.
Figure 8:
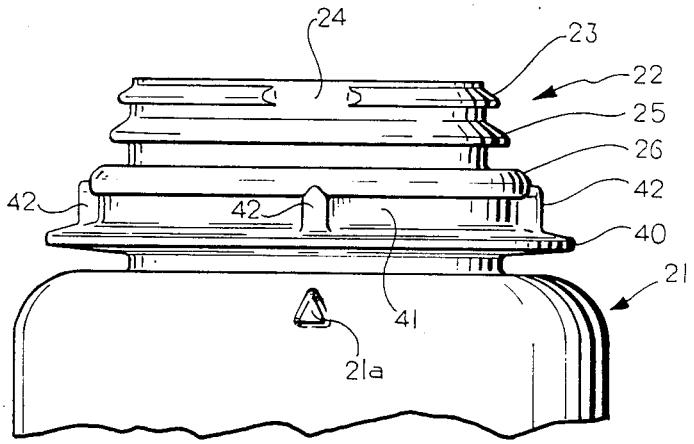
FIG. 8 is a fragmentary elevational view of the container.

Referring to FIGS. 1–10, the child-resistant package embodying the invention comprises a closure 20 and a container 21. The closure 20 is preferably made of organic plastic material such as high density polyethylene and the container 21 is preferably made of organic plastic material such as high density polyethylene but also may be made of glass.

In accordance with the invention, the container 21 has a neck finish 22 formed with a first or upper annular retaining bead 23 having a notch 24 in its periphery and a second or lower continuous annular bead 25. The container is further formed with a protective flange 26 extending radially outwardly from and axially spaced below the second retaining bead 25 and an indicia **21*a* on the shoulder aligned with notch 24. The outer diameter of the upper retaining bead 23 is less than the diameter of the lower retaining bead 25. Each bead 23, 25 has inclined upper surfaces to facilitate snap action assembly. The upper bead 23** has a lower generally horizontal or radial surface to facilitate locking.

The closure 20 includes a flat top or panel portion 27 and a peripheral skirt portion 28. An external lifting tab 29 is provided on the outer surface of the skirt 28 and a first radially inwardly extending locking lug 30 having an arcuate extent substantially equal to or less than the arcuate extent of the notch 24 is provided on the inner surface of the skirt 28 adjacent the lifting tab 29. The first lug 30 is provided axially on the skirt in a position such that it extends beneath the first retaining bead 23 when the closure is in position on the container and preferably does not contact bead 23.

The skirt 28 is further formed with at least one radially inwardly extending locking lug 32 generally diametrically opposite to first locking lug 30. Lug 32 is axially positioned along the skirt near the lower edge so that it will engage below the second retaining bead 25 when the closure is on the finish. Preferably, a plurality of lugs 32 are provided, shown as a pair of lugs, and each having a greater arcuate extent than lug 30.

The skirt is further formed with at least one integral arcuate stabilizing bead 34 opposite the longer lugs 32, and below the first locking lug which is adapted to engage beneath the second retaining bead 25 and stabilize the rotation of the closure so that it will rotate evenly.

The diametral distance between the stabilizing bead 34 and the second locking lugs 32 is greater than the diameter of the upper or first retaining bead 23 on the finish of the container. The stabilizing bead 34 maintains contact with the second retaining bead 25 even when the first locking lug 30 is oriented into register with the notch 24, thereby preventing upward movement of the closure 20. Thus, the stabilizing bead 34 cooperating with the lower retaining bead 25 functions to prevent any axial motion that might suggest to a child that the closure is in a position for removal.

As a result of the construction, there is a substantial clearance between the inner surface of the skirt 28 of the closure 20 and the upper retaining bead 23 and a snug circumferential contact between the inner surface of the skirt 28 and the lower retaining bead 25.

In order to permit less stringent manufacturing tolerances, the closure includes a plurality of tangential flat-faced facets 35 in the skirt of the closure adapted to frictionally engage the lower retaining bead 25 and thereby provide maximum closure retention over the tolerances of the closure and finish. The facets 35 thus prevent lateral or radial movement of the closure relative to the finish so that the engagement with the lower retaining bead 25 is maintained even though there are variations in the dimensions of the closure and finish in the manufacture thereof.

In order to provide moisture vapor transmission resistance to the package, a liner 36 of expanded plastic material is preferably positioned in the top of the closure between the top wall 27 and the upper end of the finish.

The closure 20 can be applied to the finish in any oriented position of the closure relative to the finish merely by snapping the closure onto the finish. By having the diameter of the upper retaining bead 23 smaller than the diameter of the lower retaining bead 25, and the diametral distance between the lower locking lugs 32 and the stabilizing segment 34 being greater than the diameter of the upper retaining bead 23, the lower retaining bead 25 and stabilizing segment 34 are prevented from engaging the upper bead 23 thereby preventing inadvertent unlocked attachment when the closure is partially applied.

When it is desired to remove the closure, it is rotated bringing the external tab 29 into registry with indicia 21*a* on the exterior of the container and then an upward force is applied to the tab 29 permitting the lug 30 to be moved freely through the notch 24 and the closure to be removed by a tipping movement.

The use of upper and lower retaining beads 23, 25 on the finish with two lugs 30 and 32 on the closure at different axial or elevational positions within the closure combined with the stabilizing segment 34 causes the closure to rotate evenly without noticeable elevation of the closure when the closure is placed in the opening position as when the closure is brought into registry with the indicia inadvertently, for example, by a child. This feature is especially effective when a liner is used since the liner tends to lift the closure firmly against the retaining beads.

The use of two retaining beads on the finish, one of which has a notch, causes the closure to rotate smoothly even though the finish may be distorted due to tolerances. The use of the facets 35 within the closure insures that the closure is prevented from moving laterally with respect to the finish to thereby provide proper interference fit with the annular lower bead under most variations of tolerances of the closure of finish.

When the closure is on the container, the protective flange 26 extends radially outwardly below the lower edge of skirt 28 of closure 20 and in close proximity thereto to prevent access to the lower edge of the skirt so that the skirt can not be pried away from the closure.

The closure may comprise a pair of locking lugs at the upper level adapted to be registered with a pair of notches on the container and a single locking lug is provided for engagement with lower retaining bead. It can thus be seen that other arrangements of locking lugs can be provided at the upper level to provide the desired locking in combination with one or more opposed locking lugs at the lower level.

The package heretofore described is like that shown in U.S. Pat. No. 4,375,859, which is incorporated herein by reference.

In accordance with the invention, the container is formed with a second annular flange 40 that extends radially outwardly beyond flange 26 and spaced axially from flange 26. The wall 41 between flanges 26 and 40 is formed with a plurality of axially extending ribs 42 which project radially outwardly from flange 26, herein shown as four in number.

Closure 20 is provided with an integral tamper indicating band 43 which is connected to the lower end of skirt 28 by a plurality of circumferentially spaced bridge portions 44 which define a weakened line. The inner surface of the band 43 is formed with a plurality of circumferentially spaced vertical ribs 45. The lower ends of ribs 45, as shown herein, and the upper ends of ribs 42 are preferably pointed to facilitate application of the closure to the container.

Figure 9:
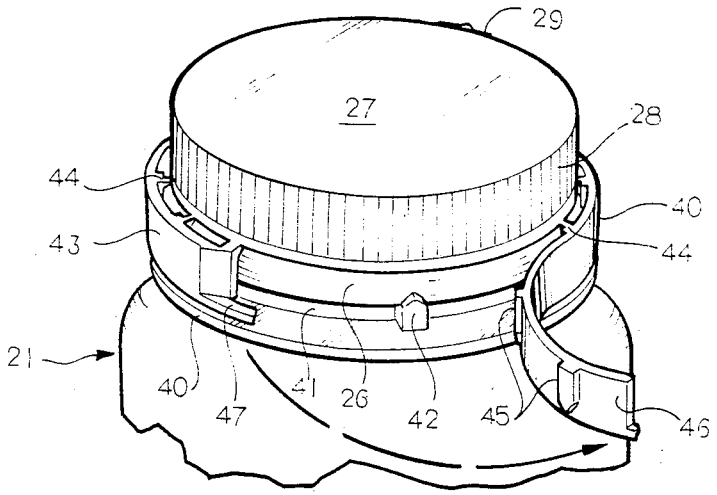
FIG. 9 is a fragmentary perspective viewing showing the start of tearing off the tamper indicating band.
Figure 10:
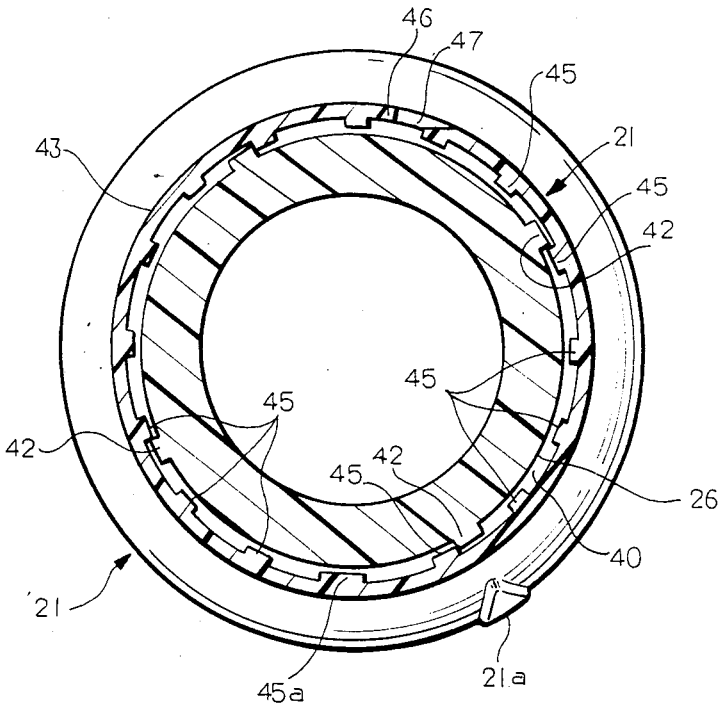
FIG. 10 is a sectional view taken along the line 10—10 in FIG. 5.

One rib 45*a* of the ribs 45, adjacent to and circumferentially aligned with locking lug 30, is circumferentially positioned so that when the closure is snapped onto the container, the locking lug 30 on the container can not be aligned with the notch 24 and the closure can not be rotated until the band is removed. In order to facilitate removal of the band, a vertical slot 46 is provided in the band that extends to a circumferential strip 47 providing a tab 48 that can be pulled to remove the band as shown in FIG. 9.

The second flange 40 of larger diameter protects the tamper indicating band and prevents abrasion of the user's hands while handling the container.

It can thus be seen that there has been provided an orientable child-resistant package which provides both child resistance and tamper resistance without the need of one or more additonal components such as overwraps, shrink bands, or foil type liners.

I claim:

1. A tamper resistant child resistant package with a snap-on closure comprising a container having a neck finish, said neck finish including a retaining bead having at least one notch therein, a closure having a top wall and peripheral skirt, a radially extending lug on the inner surface of said skirt adapted to be aligned with said notch to permit removal of said closure, an integral tamper indicating band connected to the skirt of said closure by means defining a weakened line, a plurality of circumferentially spaced vertical ribs on the inner surface of said tamper indicating band, a plurality of circumferentially spaced vertical ribs on the outer surface of said container below said retaining bead, said ribs on said closure and said ribs on said container being arranged such that when the closure is snapped onto the container, the ribs interengage to position the closure in such a manner that the locking lug on the container can not be aligned with the notch on the container and prevent rotation of the closure to bring the locking lug into alignment with the notch until the band is removed.

2. The tamper resistant child resistant package set forth in claim 1 wherein a rib on the band is aligned with the locking lug.

3. The tamper resistant child resistant package set forth in claim 2 wherein said rib which is aligned with said locking lug has a width in a circumferential direction which is greater than the width of the remaining ribs on said tamper indicating band.

4. The tamper indicating child resistant package set forth in claim 1 wherein some of said ribs have pointed ends to facilitate assembly of said closure to said container.

5. The tamper resistant child resistant package set forth in any of claims 1–4 wherein said band includes a tab to facilitate grasping the band to sever it from the closure.

6. A tamper resistant child resistant snap-on closure for use with a container having a neck finish, said neck finish including a retaining bead having at least one notch therein, said a closure having a top wall and peripheral skirt, a radially extending lug on the inner surface of said skirt adapted to be aligned with a notch on the container to permit removal of said closure, an integral tamper indicating band connected to the skirt of said closure by means defining a weakened line, a plurality of circumferentially spaced vertical ribs on the inner surface of said tamper indicating band adapted to interengage a plurality of circumferentially spaced vertical ribs on the outer surface of said container below said retaining bead, such that when the closure is snapped onto the container, the ribs interengage to position the closure in such a manner that the locking lug on the container can not be aligned with the notch on the container and prevent rotation of the closure to bring the locking lug into alignment with the notch until the band is removed.

7. The tamper resistant child resistant closure set forth in claim 6 wherein a rib on the band is aligned with the locking lug.

8. The tamper resistant child resistant closure set forth in claim 7 wherein said rib which is aligned with said locking lug has a width in a circumferential direction which is greater than the width of the remaining ribs on said tamper indicating band.

9. The tamper indicating child resistant closure set forth in claim 6 wherein some of said ribs have pointed ends to facilitate assembly of said closure to said container.

10. The tamper resistant child resistant closure set forth in any of claims 6–9 wherein said band includes a tab to facilitate grasping the band to sever it from the closure.

11. A child resistant package with a snap-on closure comprising a container having a neck finish, said neck finish including a first upper annular retaining bead, a second lower annular retaining bead spaced axially beneath the first annular bead and a flange extending radially outwardly and being axially spaced below the second bead, said first annular bead having a notch therein, said second annualr bead being continuous, a closure having a top and a peripheral skirt, said skirt having a lifting tab on the outer surface thereof, a first radially inwardly extending locking lug on the inner surface thereof adjacent the external lifting tab, said skirt having at least one second radially inwardly extending locking lug located generally diametrically opposite from the lifting tab and axially below the plane of the first locking lug, such that when the closure is assembled to the finish, the first locking lug is located below the first retaining bead and the second locking lug is located beneath the second retaining bead, and when the first locking lug is brought into registry with the notch, the closure can be removed by upward force on the lifting tab, an integral tamper indicating band connected to the skirt of said closure by means defining a weakened line, a plurality of circumferentially spaced vertical ribs on the inner surface of said tamper indicating band, a plurality of circumferentially spaced vertical ribs on the outer surface of said container below said retaining bead, said ribs on said closure and said ribs on said container being arranged such that when the closure is snapped onto the container, the ribs interengage to position the closure in such a manner that the locking lug on the container can not be aligned with the notch on the container and prevent rotation of the closure to bring the locking lug into alignment with the notch until the band is removed.

12. The tamper resistant child resistant package set forth in claim 11 wherein a rib on the band is aligned with the locking lug.

13. The tamper resistant child resistant package set forth in claim 12 wherein said rib which is aligned with said locking lug has a width in a circumferential direction which is greater than the width of the remaining ribs on said tamper indicating band.

14. The tamper indicating child resistant package set forth in claim 11 wherein some of said ribs have pointed ends to facilitate assembly of said closure to said container.

15. The tamper resistant child resistant package set forth in any of claims 11–14 wherein said band includes a tab to facilitate grasping the band to sever it from the closure.

* * * * *